US005416979A

United States Patent [19]

Joiner

[11] Patent Number: 5,416,979

[45] Date of Patent: May 23, 1995

[54] PAPER WEB DRYER AND PAPER MOISTURE PROFILING SYSTEM

[75] Inventor: John R. Joiner, Vancouver, Wash.

[73] Assignee: James River Paper Company, Inc., Richmond, Va.

[21] Appl. No.: 225,812

[22] Filed: Apr. 11, 1994

[51] Int. Cl.[6] ..... F26B 11/02

[52] U.S. Cl. ..... 34/114; 34/120; 34/122; 34/123

[58] Field of Search ..... 34/123, 122, 120, 114

[56] References Cited

U.S. PATENT DOCUMENTS 2,268,988 1/1942 Hess et al. .
2,576,274 11/1951 Albright ..... 34/122
3,163,502 12/1964 Justus et al. .
3,377,056 4/1968 Boye .

*Primary Examiner*—Henry T. Bennett
*Assistant Examiner*—Siddharth Ohri
*Attorney, Agent, or Firm*—Thomas R. Lampe

[57] ABSTRACT

Apparatus for drying a wet paper web during manufacture of the paper web. The apparatus allows the moisture profile of the web to be carefully controlled and adjusted. The apparatus includes a rotatable dryer drum and a hood partially encompassing the rotatable dryer drum. A plurality of elongated heater nozzle boxes are disposed in the hood interior and extend across the dryer drum in the cross-machine direction, the elongated heater nozzle boxes being arrayed side-by-side in the machine direction. A plurality of gas burners is located in each of the nozzle box interiors and arranged side-by-side along the length of the nozzle box interiors for producing hot combustion gases within the nozzle box interiors of the heater nozzle boxes.

18 Claims, 6 Drawing Sheets

PAPER WEB DRYER AND PAPER MOISTURE PROFILING SYSTEM

TECHNICAL FIELD

This invention relates to apparatus for drying a wet paper web and controlling the moisture profile of the web during manufacture.

BACKGROUND ART

A number of devices are known in the prior art for drying wet paper webs during manufacture of the paper webs. One well known device for drying wet paper webs is the yankee dryer which incorporates a heated drum carrying the wet paper web through the interior of a hood operatively associated therewith. The interior of the hood contains heated air which circulates through the hood and contacts the outer surface of the paper web. In conventional yankee dryers the air is heated at a location exterior of the hood.

A search directed to the present invention located the following United States patents: U.S. Pat. No. 2,268,988, issued Jan. 6, 1942, U.S. Pat. No. 3,163,502, issued Dec. 29, 1964, and U.S. Pat. No. 3,377,056, issued Apr. 9, 1968.

U.S. Pat. No. 3,377,056 discloses a hood having a main housing and sub-housings on either side thereof. Cooling and heating components are located in the sides of the housing. Burners are provided in the walls of plenum chambers for heating the air supplied to the paper web positioned on a yankee dryer drum.

U.S. Pat. No. 2,268,988 discloses a manifold disposed about a drum. Burners are positioned about the circumference of the drum in order to heat ink which is positioned on paper transported around the outer surface of the drum.

U.S. Pat. No. 3,163,502 is directed to a removable hood for drying a web of material conveyed around cylinders. Heating ducts are provided in each of the hood sections. Gas heated by a fire tube may be substituted for the heater ducts. The ducts are essentially identical and each provides a passage at opposite ends communicating with the exhaust air chamber.

DISCLOSURE OF INVENTION

The apparatus of the present invention is for the purpose of efficiently and uniformly drying a wet paper web such as a web of tissue during the web manufacturing process. The structural elements of the apparatus cooperate to effectively use conductive, convective and radiant heating to accomplish web drying. The apparatus also provides for effective moisture profile control during the drying operation.

The apparatus includes a rotatable dryer drum having a web support surface for supporting a wet paper web.

A hood at least partially encompasses the rotatable dryer drum and defines a hood interior for receiving a wet paper web or sheet supported by the web support surface upon rotation of the dryer drum.

A plurality of elongated heater nozzle boxes having nozzle plates are disposed in the hood interior extending across the dryer drum in the cross-machine direction and arrayed side-by-side in the machine direction. Each heater nozzle box defines a nozzle box interior and at least one exit opening in the nozzle plate leading from the nozzle box interior toward the dryer drum web support surface.

A plurality of gas burners are at least partially positioned in the nozzle box interior of each of the heater nozzle boxes and arranged side-by-side along the length of the nozzle box interior for producing hot combustion gases within the nozzle box interior of each heater nozzle box. Radiant heat from the flames of the gas burner heats the nozzle plate which in turn radiates heat to the sheet. The hot combustion gases mix with supply air and flow through the exit openings in the nozzle plate at high velocity to promote convection heat transfer to the sheet.

Each gas burner includes a burner nozzle extending along a predetermined width portion or slice of the wet paper web supported by the dryer drum web support surface. Each gas burner additionally includes an aspirator for mixing air and flammable gas and delivering the air and flammable gas mixture mixed thereby to a burner nozzle.

The heater nozzle boxes are spaced from each other, each said heater nozzle box including opposed side walls. Side walls of adjacent heater nozzle boxes define return air flow paths for receiving the supply air and combustion gases which have exited the exit openings of the heater nozzle boxes. The volume of supply air is quite large compared to the volume of combustion gases.

Other features, advantages, and objects of the present invention will become apparent with reference to the following description and accompanying drawings.

BEST MODE FOR CARRYING OUT THE INVENTION

Figure 1:
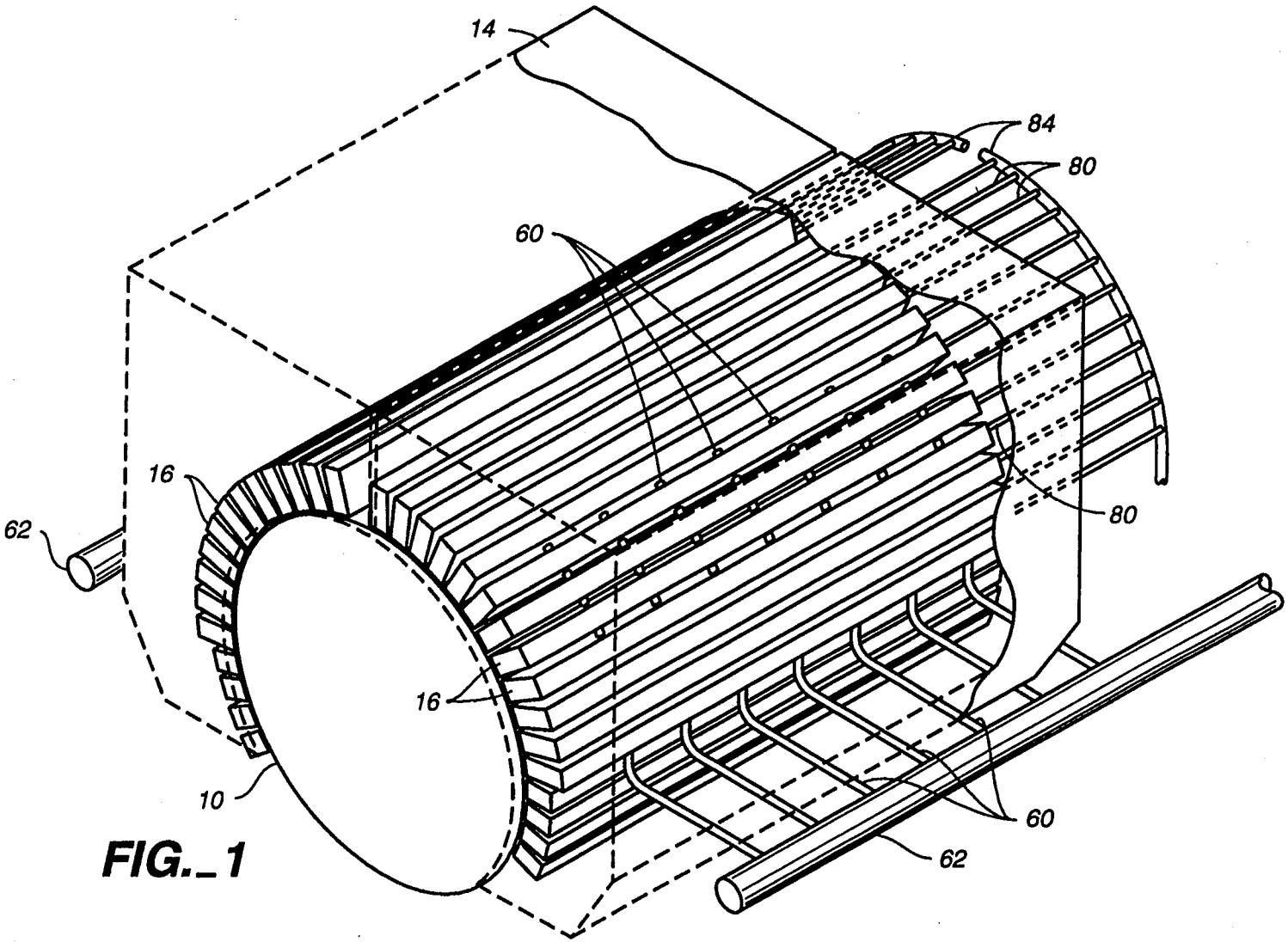
FIG. 1 is a diagrammatic, perspective view of an embodiment of apparatus constructed in accordance with the teachings of the present invention.
Figure 2:
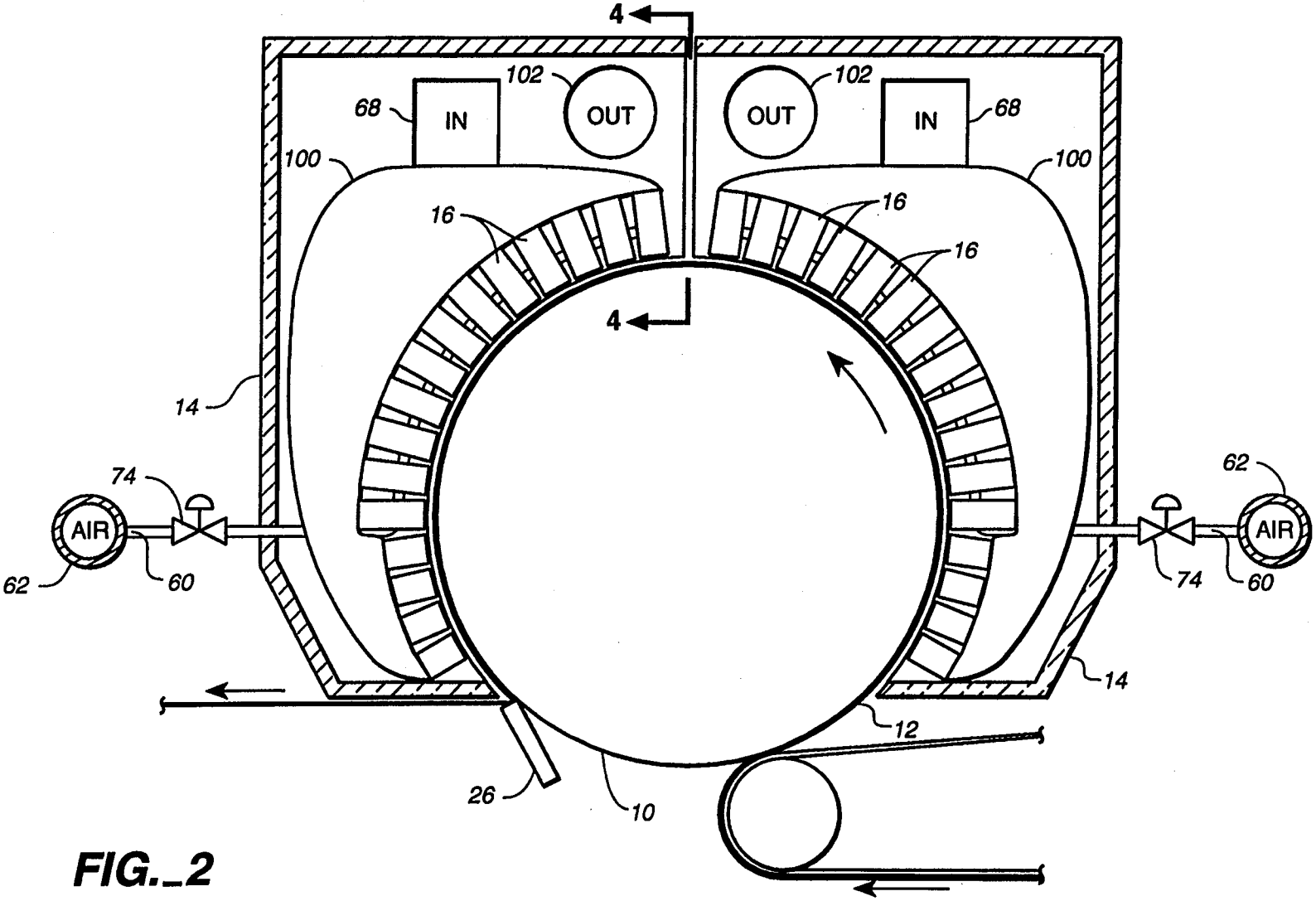
FIG. 2 is a somewhat diagrammatic, side view, in partial cross-section, illustrating selected components of the apparatus.

Referring now to the drawings, a yankee dryer drum 10 is illustrated. As is conventional, the dryer drum is heated and has a web support surface for supporting a wet paper web 12 and delivering the paper web into the interior of a dryer hood 14 upon rotation of the dryer drum.

Figure 4:
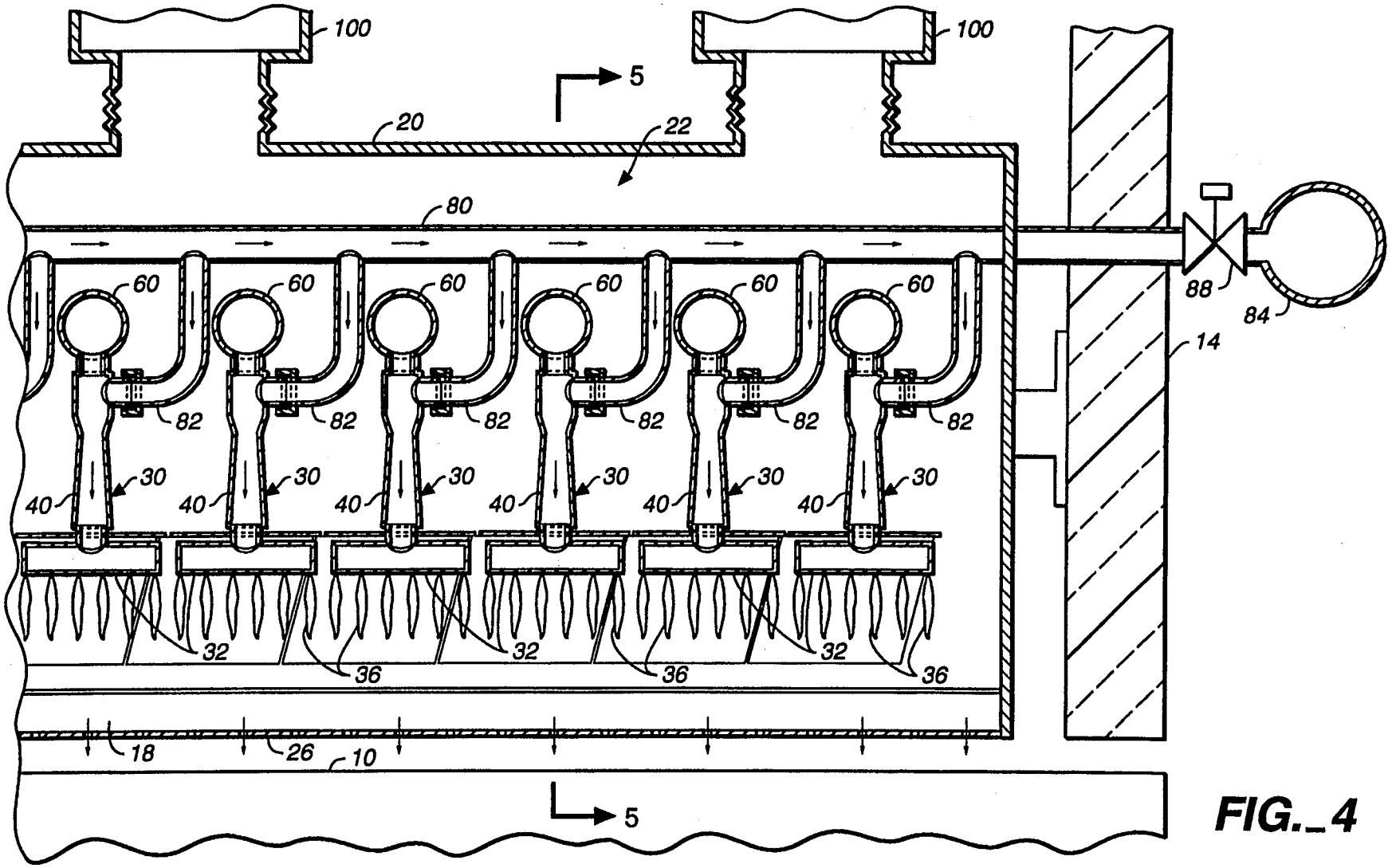
FIG. 4 is an enlarged, cross-sectional view taken along line 4—4 in FIG. 2 and illustrating a segment of a heater nozzle box and related burner structure.
Figure 5:
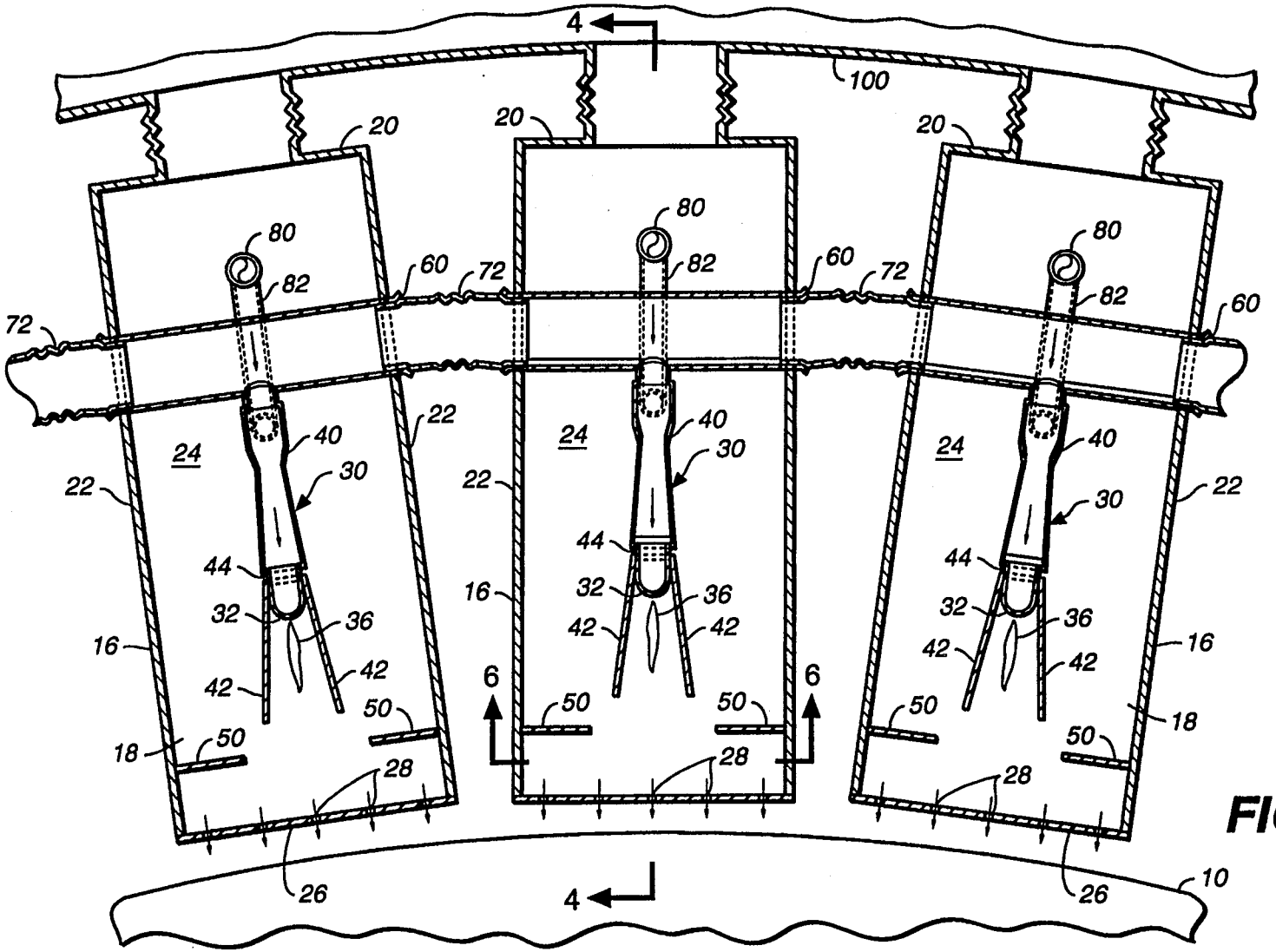
FIG. 5 is a cross-sectional view taken along the line 5—5 in FIG. 4 and illustrating the interior construction of three representative heater nozzle boxes employed in the apparatus.
Figure 6:
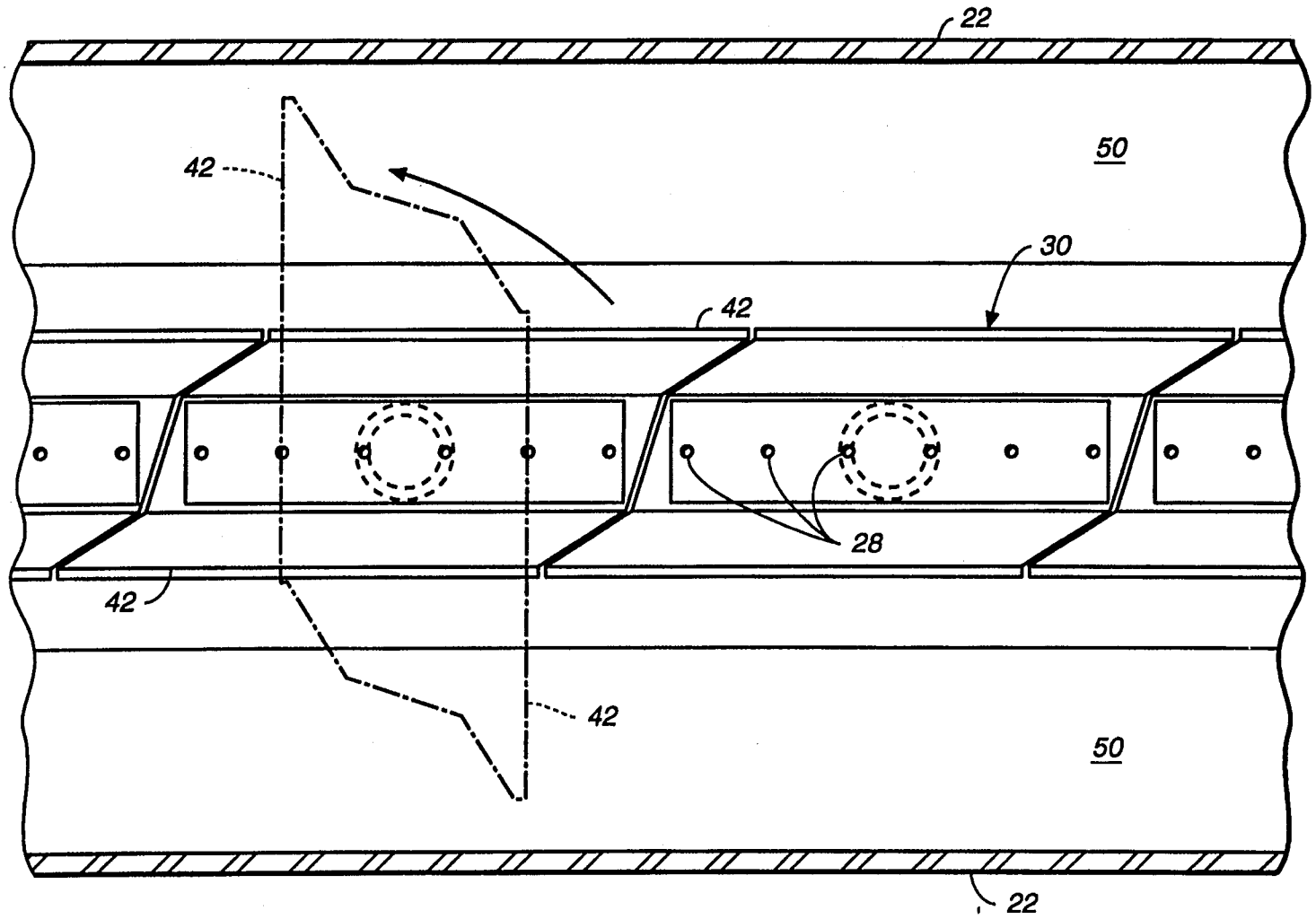
FIG. 6 is a partial sectional, enlarged, bottom view of a heater nozzle box segment and gas burners disposed therein.

According to the teachings of the present invention, in the disclosed arrangement a plurality of elongated heater nozzle boxes 16 are disposed in the interior of hood 14 and extend across the dryer drum 10 in the cross-machine direction. The heater nozzle boxes are arrayed side-by-side in the machine direction and spaced from one another. Each of the heater nozzle boxes defines a nozzle box interior 18 (FIGS. 4, 5 and 6).

Each heater nozzle box 16 includes side walls 22, end walls 24, a cap wall 20 and a nozzle plate 26. All of the aforesaid walls may be constructed of any suitable material such as high temperature alloy steel. Likewise, nozzle plate 26 may suitably be constructed of high temperature alloy steel. The heater box nozzle plates each de-fine a plurality of exit openings 28 along the lengths thereof, said exit openings providing communication with the interior of the heater nozzle box.

It will be seen that all of the elongated heater nozzle boxes 16 are located with their respective nozzle plates closely adjacent to the web support surface of the rotatable dryer drum 10. Any suitable means may be employed to mount the nozzle boxes; however, reference may be had to my co-pending U.S. patent application Ser. No. 08/214,450 filed Mar. 18, 1994 for a support system particularly adapted for use when supporting heater mounting boxes in an environment such as that found in a yankee dryer hood wherein extreme temperatures and temperature ranges are encountered.

Positioned within the interior of each of the heater nozzle boxes are a plurality of gas burners 30. The gas burners 30 are arranged side-by-side along the length of the nozzle box interior and are for producing hot combustion gases within the nozzle box interior of each heater nozzle box.

Each gas burner includes a burner nozzle 32, the burner nozzles being in the form of elongated burner nozzle segments defining a plurality of exit openings through which heated combustion gases are directed toward the nozzle plate 26. Rather then a plurality of exit openings, a single continuous slot could be utilized. FIGS. 4 and 5 show flames 36 being emitted from the exit openings of the burner nozzles.

Each gas burner also includes an aspirator 40 in the form of a venturi which will mix air and flammable gas, maintain the gas and combustion air in ratio, and deliver the air and flammable gas mixture mixed thereby to a burner nozzle.

Positioned on opposed sides of each burner nozzle 32 are flame shield plates 42. The burner nozzles and the respective flame shields extend along a predetermined width portion or slice of the wet paper web supported by the dryer drum web support surface. The flame shield plates 42 of each pair thereof are connected to each burner nozzle adjacent to the nozzle exit. In the arrangement illustrated, an intermediate support plate 44 integral with the pair of flame shield plates 42 serves to provide such support, the support plates 44 having an aperture therein which fits about the associated gas burner 30 above the burner nozzle 32. Preferably both the burner nozzles and the support plates may be removed from the rest of the gas burner structures, as for example by providing a screw interconnection therebetween, to allow replacement and/or maintenance of the burner nozzles and flame shield plates.

The shield plates of each pair of shield plates flare outwardly away from each other as illustrated and have distal ends spaced from the nozzle exit and also spaced from the heater box nozzle plate 26. In the arrangement illustrated, the shield plates of each pair of shield plates are cut on an angle. Such a configuration has been found to facilitate removal of an individual set or pair of shield plates from the associated gas burner by avoiding interference contact between the pair of plates being removed and one or more adjacent pairs when the pair is unscrewed from the burner structure.

The flame shield plates assist in directing the combustion gases from the burner nozzles to the nozzle plate. Additionally, the flame shield plates resist quenching of flame at the burner nozzles. The flame is very sensitive to cooling. When the flame is cooled before combustion is complete, carbon monoxide, soot and other undesirable products result. This process is known as flame quenching. The flame shield operates to protect the flame from the large volume of supply air flowing to the nozzles from associated crescent headers as will be described in greater detail below. The supply air is relatively cool as compared to flame temperature.

The flame shields form a continuous trough across the width of the sheet on the dryer drum. Their segmented construction relieves stress from thermal expansion and provides ease of manufacture and assembly. The angular shape permits any particular bar burner to be threaded out of its aspirator by rotating the adjacent flame shields ninety degrees, as illustrated in FIG. 6.

Another feature of the apparatus of the present invention is the use of air mixing elements in the form of bars or plates 50 which project inwardly from heater nozzle box side walls 22 into the interior of the heater nozzle box at a location between the distal ends of flame shield plates 42 and heater box nozzle plate 26. The air mixer elements 50 promote turbulence within the nozzle box interior 18 and thus promote thorough mixing between the products of combustion and the large volume of recirculated supply air.

An important aspect of the apparatus is the distribution system for distributing flammable gas, such as natural gas, and combustion air to the gas burners.

A plurality of air headers 60 extend between the heater nozzle boxes 16. The air headers 60 are arrayed in the machine direction and connect at one end thereof to an air supply line 62 which in turn is connected to a source of combustion air through a control valve 66.

Figure 3:
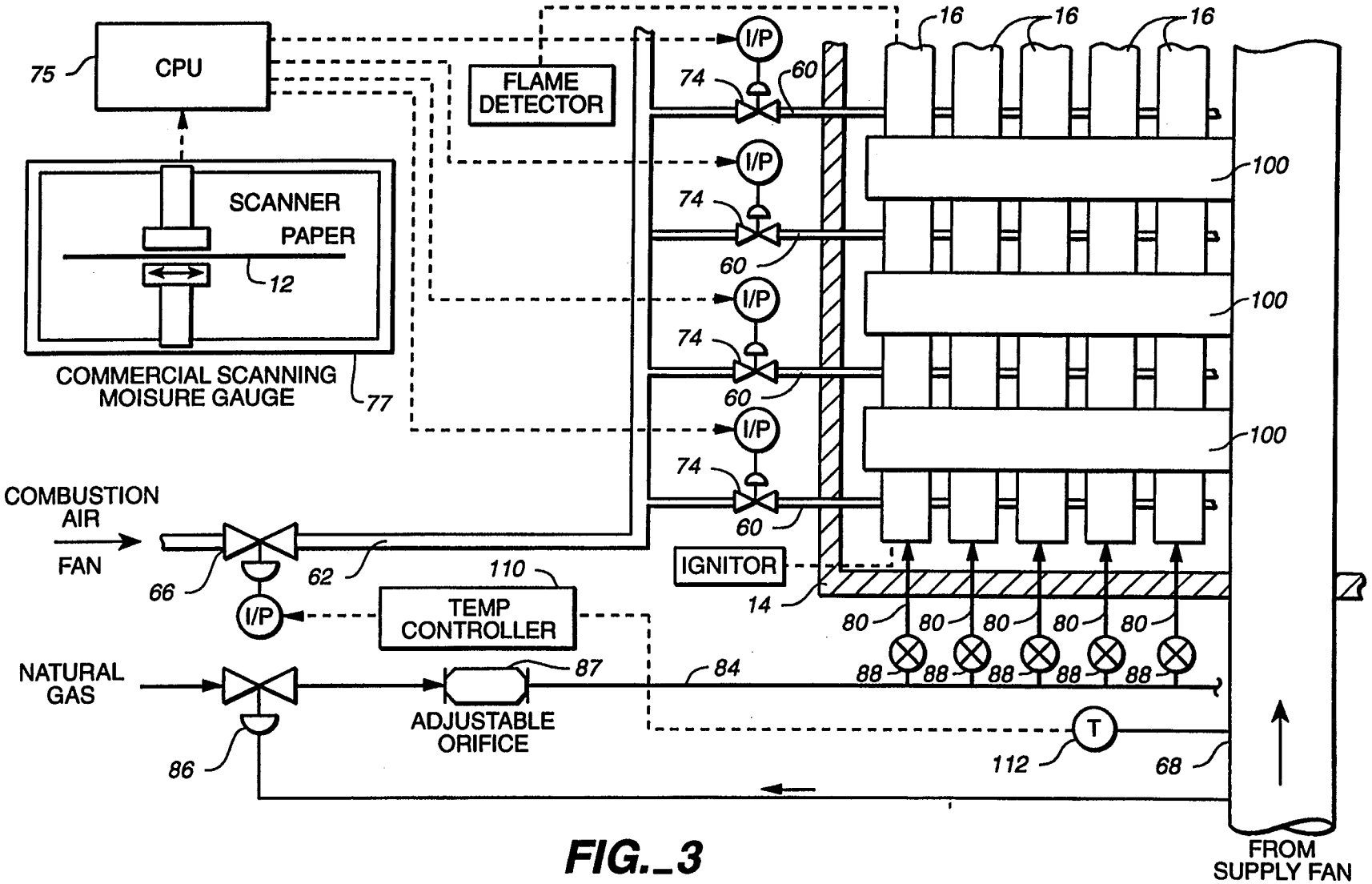
FIG. 3 is a diagrammatic view illustrating portions of heater nozzle boxes employed in the apparatus and combustion air and flammable gas distribution means employed in conjunction therewith.

Each of the air headers 60 supplies combustion air to the aspirator 40 of a gas burner 30 in each of the heater nozzle boxes. As can be seen with reference to FIG. 5, wherein a single air header 60 is shown, the air headers include expansion joints 72 between adjacent heater nozzle boxes to compensate for temperature changes. Control valves 74 (see FIG. 3) are in operative association with each of the air headers 60 and placed between the air supply line 62 and the hood 14. Thus the flow of combustion air passing through the air headers 60 can be controlled. If desired, the control valves 74 can be automatically controlled to control the flow of air therethrough. FIG. 3 illustrates such an arrangement wherein a suitably programmed central processing unit 75 operates valves 74 based on inputs received from a scanning moisture gauge 77 of any known commercial type which monitors the moisture profile of web 12 after it is creped from the yankee. Air flow through individual control valves can be modified in response to the sensed moisture profile to control the moisture profile.

A flammable gas header 80 is also operatively associated with the heater nozzle boxes 16. More particularly, a flammable gas header 80 extends the length of each of the heater nozzle boxes in the cross-machine direction. Flammable gas feeder lines 82 lead from the flammable gas headers 80 to the aspirators 40, it being understood that one such flammable gas feeder line 82 is connected to each aspirator. The aspirator, being in the nature of a venturi, draws the relatively unpressurized gas into the interior of the aspirator as a result of the flow of combustion air through the aspirator. Thus, when the supply of combustion air to any particular aspirator is modulated, the flow of gas into that particular aspirator will also be modulated. The continuously flowing combustion air cools the aspirator and burner below the ignition temperature of the gas.

Flammable gas, typically natural gas, is supplied to all of the flammable gas headers 80 by a manifold 84. Preferably the manifold 84 also has a backpressure regulator 86 operatively associated therewith. The back pressure regulator is a diaphragm actuated valve of conventional construction and controls the gas pressure at the regulator to match the supply air pressure. An adjustable orifice valve 87 is located downstream from the regulator 86 and provides a means to adjust the fuel to air ratio for all the burners with a single adjustment. This restriction results in the gas header pressure being slightly less than the supply air pressure.

As illustrated schematically with respect to one of the nozzle boxes 16 in FIG. 3, each nozzle box is equipped with an igniter and a flame detector. The flame detector is mounted at the opposite end from the igniter to ensure that the bank of burners has ignited over the full width of the machine. Gas cut-off valves 88 are disposed in headers 80 between the hood and the flammable gas manifold 84. The gas cut-off valves provide positive gas shut off to an entire nozzle box in the event of an unsafe condition such as loss of flame. This is to be compared with the operation of the individual combustion air valves 74 which modulate the air flow (and via the aspirators, the gas flow) to level the moisture profile.

It will be appreciated that the wet paper web is partially dried by the drum because the underside thereof is in direct engagement with the heated drum web support surface.

Air passing through the exit openings of the heated nozzle plates impinges against the outer surface of the wet paper web and is recirculated between the heater nozzle boxes and out of the hood interior. Radiant heat energy is received by the web from the heated nozzle plates. Heating efficiency is thus promoted by using conductive, convective and radiant heat energy.

In the illustrated system the heater nozzle boxes 16 are connected at the upper ends thereof to crescent headers 100 extending in the machine direction. As is conventional, crescent headers 100 receive recirculated supply fan air from the hood interior through a duct 68 in communication with the hood interior through one or more exit ports 102. The fan means for providing such circulation is conventional and has not been illustrated. The recirculated supply air mixes with the combustion gases from gas burners 30.

A tap line leads from the interior of duct 68 to backpressure regulator 86, the objective being to maintain the gas flowing through manifold 84 at the same pressure as the supply fan air.

A temperature controller 110 is operatively associated with control valve 66 to control the flow of combustion air in response to the temperature sensed by temperature sensor 112 of the recirculated air in duct 68.

I claim:

1. Apparatus for drying a wet paper web during manufacture of the paper web by conductive, convective and radiant heat energy simultaneously applied to the paper web, said apparatus comprising, in combination:

a heated rotatable dryer drum having a web support surface supporting a wet paper web;

a hood at least partially encompassing said rotatable dryer drum and defining a hood interior for receiving the wet paper web supported by said dryer drum web support surface upon rotation of said dryer drum;

a plurality of elongated heater nozzle boxes disposed in said hood interior extending continuously across said dryer drum in the cross-machine direction, arrayed side-by-side in the machine direction, and extending completely across the wet paper web supported by said dryer drum web support surface, each said heater nozzle box defining a nozzle box interior and at least one exit opening leading from said nozzle box interior toward said dryer drum web support surface;

a plurality of gas burners at least partially positioned in the nozzle box interior of each of said heater nozzle boxes and arranged side-by-side along the length of the nozzle box interior for producing hot combustion gases within the nozzle box interior of each heater nozzle box and along the length thereof, said heater nozzle boxes applying radiant heat energy to the wet paper web supported by said dryer drum web support surface and directing heated combustion air from the nozzle box interiors through the exit openings of the heater nozzle boxes toward the wet paper web supported by said dryer drum web support surface, each said gas burner including a burner nozzle within a nozzle box interior extending along a predetermined width portion of the wet paper web supported by said dryer drum web support surface and an aspirator for mixing air and flammable gas and delivering the mixture of air and flammable gas mixed thereby to the burner nozzle, each said burner nozzle comprising an elonqated nozzle segment, and elongated nozzle segments of the plurality of gas burners positioned in the nozzle box interiors of said heater nozzle boxes extending in alignment along the length of their respective heater nozzle box, said heater nozzle boxes being spaced from each other, each said heater nozzle box including opposed side walls, and side walls of adjacent heater nozzle boxes defining return air flow paths for receiving combustion air after the combustion air has exited the exit openings of said heater nozzle boxes, said heater nozzle boxes including nozzle plates defining said exit openings, said nozzle plates extending across said dryer drum in the cross-machine direction, said plurality of elongated heater nozzle boxes being located with their respective nozzle plates closely adjacent to the web support surface of said rotatable dryer drum, heated gases from said plurality of burner nozzles impinging against said nozzle plates of said heated nozzle boxes to heat said nozzle plates and exiting the exit openings of said heater nozzle boxes adjacent to the wet paper web supported by said rotatable heater drum.

2. The apparatus according to claim 1 additionally comprising a plurality of flame shields disposed within each heater nozzle box and extending outwardly from each burner nozzle within the nozzle box interior of the heater nozzle box.

3. The apparatus according to claim 2 wherein each burner nozzle has a nozzle exit and wherein each flame shield comprises a pair of shield plates connected to each burner nozzle adjacent to the nozzle exit, the shield plates of each pair of shield plates flaring outwardly away from each other and having distal ends spaced from said nozzle exit.

4. The apparatus according to claim 3 wherein the shield plates of each pair of shield plates are affixed to each other and releasably connected to a burner nozzle.

5. The apparatus according to claim 4 wherein shield plates of each pair of shield plates are cut on an angle to facilitate removal thereof from a burner nozzle.

6. The apparatus according to claim 3 additionally comprising air mixer elements connected to said heater nozzle boxes and extending into the nozzle box interiors between said shield plate distal ends and the at least one exit opening of the heater nozzle boxes to create turbulence and facilitate mixture of gases within the nozzle box interiors.

7. The apparatus according to claim 1 additionally comprising at least one air header extending between said plurality of elongated heater nozzle boxes in the machine direction for delivering combustion air to the aspirators of the gas burners within said heater nozzle boxes.

8. The apparatus according to claim 7 additionally comprising flammable gas conduit means for supplying flammable gas to the aspirators of the gas burners within said heater nozzle boxes.

9. The apparatus according to claim 1 wherein said aspirators are at least partially located within said nozzle box interiors, said apparatus additionally comprising combustion air delivery means including at least one air header extending into said nozzle box interiors and in fluid flow communication with said aspirators.

10. The apparatus according to claim 8 wherein the flammable gas conduit means includes a flammable gas header operatively associated with and extending substantially along the length of each heater nozzle box in the cross-machine direction and flammable gas feeder lines extending between said flammable gas header to each of the aspirators within the respective heater nozzle box.

11. The apparatus according to claim 1 additionally including air supply valve means for controlling the flow of air and flammable gas to said aspirators.

12. The apparatus according to claim 10 additionally comprising valve means operatively associated with each flammable gas feeder line for terminating the flow of flammable gas to all of the gas burners in a heater nozzle box.

13. The apparatus according the claim 12 additionally comprising igniter means for igniting the gas burners in each nozzle box and flame detector means for detecting flame from the gas burners in each nozzle box.

14. Apparatus for drying a wet paper web during manufacture of the paper web, said apparatus comprising, in combination:

a rotatable dryer drum having a web support surface for supporting a wet paper web;

a hood at least partially encompassing said rotatable dryer drum and defining a hood interior for receiving a wet paper web supported by said web support surface upon rotation of said dryer drum;

a plurality of elongated heater nozzle boxes disposed in said hood interior extending across said dryer drum in the cross-machine direction and arrayed side-by-side in the machine direction, each said heater nozzle box defining a nozzle box interior and at least one exit opening leading from said nozzle box interior toward said dryer drum web support surface;

a plurality of gas burners at least partially positioned in the nozzle box interior of each of said heater nozzle boxes and arranged side-by-side along the length of the nozzle box interior for producing hot combustion gases within the nozzle box interior of each heater nozzle box, said heater nozzle boxes applying radiant heat energy to a wet paper web on said dryer drum web support surface and directing heated combustion air from the nozzle box interiors through the exit openings of the heater nozzle boxes toward the wet paper web supported by said dryer drum web support surface, each said gas burner including a burner nozzle extending along a predetermined width portion of the wet paper web supported by said dryer drum web support surface; and a plurality of flame shields disposed within each heater nozzle box and extending outwardly from each burner nozzle within the nozzle box interior of the heater nozzle box.

15. The apparatus according to claim 14 wherein each burner nozzle has a nozzle exit and wherein each flame shield comprises a pair of shield plates connected to each burner nozzle adjacent to the nozzle exit, the shield plates of each pair of shield plates flaring outwardly away from each other and having distal ends spaced from said nozzle exit.

16. The apparatus according to claim 15 wherein the shield plates of each pair of shield plates are affixed to each other and releasably connected to a burner nozzle.

17. The apparatus according to claim 16 wherein shield plates of each pair of shield plates are cut on an angle to facilitate removal thereof from a burner nozzle.

18. The apparatus according to claim 15 additionally comprising air mixer elements connected to said heater nozzle boxes and extending into the nozzle box interiors between said shield plate distal ends and the at least one exit opening of the heater nozzle boxes to create turbulence and facilitate mixture of gases within the nozzle box interiors.

* * * * *